US006053996A

United States Patent [19]

Pronk et al.

[11] Patent Number: 6,053,996

[45] Date of Patent: Apr. 25, 2000

[54] METHOD FOR THE MANUFACTURE OF A STRIP OF FORMABLE STEEL

[75] Inventors: Cornelis Pronk, Castricum; Huibert Willem Den Hartog, Noordwijkerhout; Marcus Cornelis Maria Cornelissen, Castricum, all of Netherlands

[73] Assignee: Hoogovens Staal BV, Ijmuiden, Netherlands

[21] Appl. No.: 08/981,612

[22] PCT Filed: Jun. 28, 1996

[86] PCT No.: PCT/EP96/02874

§ 371 Date: Apr. 15, 1998

§ 102(e) Date: Apr. 15, 1998

[87] PCT Pub. No.: WO97/01402

PCT Pub. Date: Jan. 16, 1997

[30] Foreign Application Priority Data

Jun. 29, 1995 [NL] Netherlands ..... 1000694

[51] Int. Cl.[7] ..... C21D 1/09

[52] U.S. Cl. ..... 148/541; 148/546; 148/601; 148/602

[58] Field of Search ..... 148/541, 546, 148/601, 602

[56] References Cited

U.S. PATENT DOCUMENTS 4,885,041 12/1989 den Hartog et al. ..... 148/541

5,042,564 8/1991 Van Perlstein et al. ..... 164/476

FOREIGN PATENT DOCUMENTS

| | | |
|---|---|---|
| 56077321 | 6/1981 | European Pat. Off. . |
| 306076 | 3/1989 | European Pat. Off. . |
| 370575 | 5/1990 | European Pat. Off. . |
| 504999 | 9/1992 | European Pat. Off. . |
| 524162 | 1/1993 | European Pat. Off. . |
| 659891 | 6/1995 | European Pat. Off. . |
| 923134 | 6/1954 | Germany . |
| 62-089501 | 4/1987 | Japan . |
| 62-114701 | 5/1987 | Japan . |
| 87549 | 10/1989 | Luxembourg . |

*Primary Examiner*—Sikyin Ip

*Attorney, Agent, or Firm*—Stevens, Davis, Miller & Mosher, L.L.P.

[57] ABSTRACT

A method for the manufacture of a strip of formable steel comprises the steps of (i) forming liquid steel by continuous casting into a slab having a thickness of not more than 100 mm, (ii) rolling the slab in the austenitic region into an intermediate slab having a thickness in the range 5 to 20 mm, (iii) cooling the intermediate slab to below the $Ar_3$ temperature, (iv) holding the intermediate slab in an enclosure for temperature homogenisation, (v) rolling the intermediate slab into strip, with at least one rolling pass applying a thickness reduction of more than 50%, at a temperature below $T_t$ and above 200° C., wherein $T_t$ is the temperature at which 75% of the steel is converted into ferrite, and (vi) coiling said strip at a temperature above 500° C. Advantages of simplicity of the method and the plant required for it are obtained.

7 Claims, 1 Drawing Sheet

METHOD FOR THE MANUFACTURE OF A STRIP OF FORMABLE STEEL

FIELD OF THE INVENTION

This invention relates to a method for the manufacture of a strip of formable steel.

DESCRIPTION OF THE PRIOR ART

EP-A-370575 describes a method for making formable steel strip in which liquid steel is formed in a continuous casting machine into a thin slab with a thickness smaller than 100 mm, and, with use of the casting heat, the steel slab is rolled in the austenitic range into an intermediate slab. The intermediate slab is cooled to a temperature below $Ar_3$ and, at a temperature below $T_t$, at which 75% of the material is converted into a ferrite, and above 200° C. is rolled into the strip. A drawback of this method is that, to use it for manufacturing a steel strip with good forming properties, it requires a complicated plant, not least because of the proposed large reduction in the ferritic range and the recrystallisation furnaces needed for obtaining a desired structure. Related methods, less relevant to the present discussion are disclosed in EP-A-306076 and EP-A-504999.

SUMMARY OF THE INVENTION

One object of the invention is to provide a method which can be carried out continuously and with a simple plant, and by which a steel strip with good forming properties can be obtained.

In one aspect the invention provides a method for the manufacture of a strip of formable steel, comprising the steps of, in the following order:

(i) by continuous casting, forming liquid steel into a slab having a thickness of not more than 100 mm, (ii) rolling the slab, while it is still hot from its casting and in the austenitic region, into an intermediate slab having a thickness in the range 5 to 20 mm, (iii) cooling the intermediate slab to a temperature which is below the $Ar_3$ temperature of the steel, (iv) holding the intermediate slab in an enclosure for temperature homogenisation thereof, (v) rolling the intermediate slab into strip, with at least one rolling pass applying a thickness reduction of more than 50%, the intermediate slab being below a temperature $T_t$ at which 75% of the steel is converted into ferrite and above 200° C., (vi) coiling the strip at a temperature above 500° C.

This method requires a smaller number of process stages. By this method good forming properties may be achieved without the steel strip requiring recrystallisation annealing. The finishing train by which the intermediate slab is rolled into the strip may be of simple construction because only a relatively small reduction is made. Another advantage is that, because the mean temperature during the entire process is on average higher, the rolling forces are on average lower. The plant for carrying out the method may then be built lighter and with a lower installed capacity.

Another advantage is that storage from the homogenisation can allow sufficient time for precipitation to TiC in the case of IF steel.

Preferably the steel strip is coiled at a temperature above 600° C. So-called self-annealing then occurs in the coiled coil as a consequence of the heat content of the steel strip.

Another advantage of the relatively thin intermediate slab is that the thickness reduction in the ferritic region is relatively small and that the relationship between exit speed and entry speed is thus relatively low. The exit speed may be set at around a conventional value of 600 m/min, for which technology is available. Because the intermediate slab is relatively thin the entry speed is still high. The advantage of this is that the time that the intermediate slab is exposed to the surrounding atmosphere, thus allowing oxide to form on its surface, is brief. Therefore, with the method it is possible to make a strip with little oxide space. The entry speed is preferably >0.8 m/s.

Improved deformation properties of the steel strip are obtained because the intermediate slab undergoes at least one pass having at least 50% reduction in the ferritic region. Such deformation is quite adequate for introducing recrystallisation. In addition the advantage is achieved that, with such deformation, the temperature drop of the steel as a consequence of heat loss to the surroundings and to the mill rolls may be considerably compensated for by the deformation energy introduced into the steel during rolling. By applying this reduction, virtually no heat loss occurs in the rolling train, so that the intermediate slab can be rolled in the first mill stands at relatively low temperatures and less oxide will form.

The reduction in this pass is preferably less than 60%, more preferably less than 55%. In the case of large-reduction passes non-linearities start to play a part and lead to the problem that the rolled steel is difficult to control in and after the rolling apparatus.

Especially effective is a preferred embodiment of the method in which lubrication rolling is carried out in at least one pass in the ferritic region. Lubrication rolling reduces the rolling forces, achieves a good surface condition and the deformation applied by the pass is uniformaly distributed across the cross-section, so that homogeneous material properties are obtained. This lubrication rolling pass is optionally the pass in which more than 50% reduction is performed.

A crystal structure and a crystal size distribution which are favourable for ferritic rolling are achieved if the cast slab in the continuous casting is reduced in thickness with its core still liquid.

The steel strip is preferably rolled to a thickness less than 1.0 mm.

The method according to the invention can be carried out with a plant for the manufacture of steel strip, comprising (a) a continuous casting machine for casting a steel slab, (b) a furnace apparatus arranged for receiving the steel slab cast in the continuous casting machine (optionally with thickness reduction of the solidified slab prior to entry to the furnace apparatus), for adjusting the temperature of the steel slab, the furnace apparatus having an entry port and an exit port for the slab and an enclosed path for the slab from the entry port to the exit port, (c) a coiling apparatus for receiving the steel slab from the furnace apparatus, coiling the slab and subsequently uncoiling the slab, the coiling apparatus having an enclosure providing an enclosed space in which the slab is coiled and an entry port for entry of the slab into the enclosed space, (d) rolling apparatus for receiving the steel slab uncoiled from the coiling apparatus and rolling the slab into strip of a desired thickness, and (e) means for providing a non-oxidising gas atmosphere in the furnace apparatus at the path thereof and in the enclosed space of the coiling apparatus, wherein the exit port of the furnace apparatus is gas-tightly connected to the entry port of the coiling apparatus.

Such an apparatus and its advantages and specific embodiments are described in the International patent application "Plant for the manufacture of steel strip" with the same filing date as the present application and in the name of the same applicant, with reference no. HO 848. The content of that application is deemed to be included in the present application by this reference.

By this plant there is achieved the effect that from the time when the slab runs into the furnace apparatus until the time it is conveyed out of the coiling apparatus, the slab does not come into contact with the outside air, but rather it is continually surrounded by a gaseous atmosphere of a non-oxidizing composition. For this purpose the gaseous atmospheres in the furnace apparatus and in the coiling apparatus may be the same or different.

The gas atmosphere provided in the furnace apparatus and the coiling apparatus is substantially non-oxidizing, though inevitably it may include a small amount of oxygen due to leakage of air. Preferably it is based on nitrogen, although an inert gas such as argon may be used if its high cost allows. The nitrogen may contain additive for inhibiting nitriding of the steel surface, as is known in the process of batch annealing of steel. The gas atmosphere may contain water vapour.

Typically the furnace apparatus is built as an electric furnace in which, by means of resistance or inductive heating, energy is supplied to the slab, so that in any event the surface of the slab is heated again after having cooled as a consequence of the descaling by high pressure water sprays and because of heat loss to the surroundings. In the case of conventional plants, during this heating the surface is exposed to the normal outside atmosphere along a relatively great distance and thus for a relatively long time, so that an oxide scale again forms on the surface, which under these conditions is a thin, tenacious layer which in practice cannot be completely removed with available very high water pressures and which ultimately must be removed by pickling.

The furnace apparatus may be employed only for homogenizing the temperature of the steel slab, or may be arranged to alter at least the core of the slab in temperature.

In the plant the slab is prevented from coming into contact with the outside atmosphere as it passes through even a relatively long furnace apparatus, so that oxide scale thereby forming on the outer surface of the slab is minimized.

As stated, the coiling apparatus is provided an enclosure, i.e. screening means, for maintaining the desired gaseous atmosphere in the coiling apparatus. In the case of a conventional plant, the slab is coiled at a relatively high temperature in the coiling apparatus and stored there for some time for temperature homogenising or for waiting for further processing in the rolling apparatus. The slab is prevented from still oxidising or oxidising further during its stay in the coiling apparatus.

As mentioned the exit of the furnace apparatus is coupled essentially gas-tight to the coiling apparatus. Preferably the furnace apparatus and the coiling apparatus are detachably coupled to one another.

Other possibilities are provided with an embodiment of the plant in which the furnace apparatus is provided with cooling means for cooling the gas of the gaseous atmosphere. With this embodiment it is possible to cool the slab, if desired following roughing in the austenitic region, in a conditioned gaseous atmosphere down to the ferritic region preferably above 200° C. or to the lower part of the two-phase austenitic-ferritic region, and to coil the slab at such a temperature without a harmful amount of oxide forming on the surface. When still in the temperature region indicated, the slab may be rolled in the rolling apparatus into the steel strip of a desired thickness. This embodiment thereby opens up the possibility of making a formable steel strip having cold strip properties as regards forming behaviour and surface quality, in a very compact installation. Where still higher demands are placed on those properties, the strip may, if desired, be further processed in the conventional manner, whether or non in-line, or in a following continuous process.

Another feature which provides greater flexibility in use is that the coiling apparatus is provided with a mandrel onto which the coil can be coiled. The crop end of a slab, whether or not subjected to roughing, is clamped onto the mandrel and then coiled in the coiling apparatus into the coil in a path determined by the mandrel. This forced path makes it possible to coil a wide range of thicknesses reliably. This achieves a great freedom in the part of the process taking place prior to coiling, and it is also possible to coil thin, rolled slabs. Such slabs have a relatively large exposed surface. With the plant this surface is screened from oxygen from the outside atmosphere. Consequently it is possible to profit from the plant to the maximum.

INTRODUCTION OF THE DRAWINGS

The method according to invention will be illustrated in the following by means of a description of a non-limitative example of a plant for carrying out the method with reference to the drawings.

In the drawings:

FIG. 1 is a schematic top-view of a plant for carrying out the method of the invention, and FIG. 2 is a schematic side-view of the plant of FIG. 1.

DESCRIPTION OF THE EMBODIMENT

Figure 1:
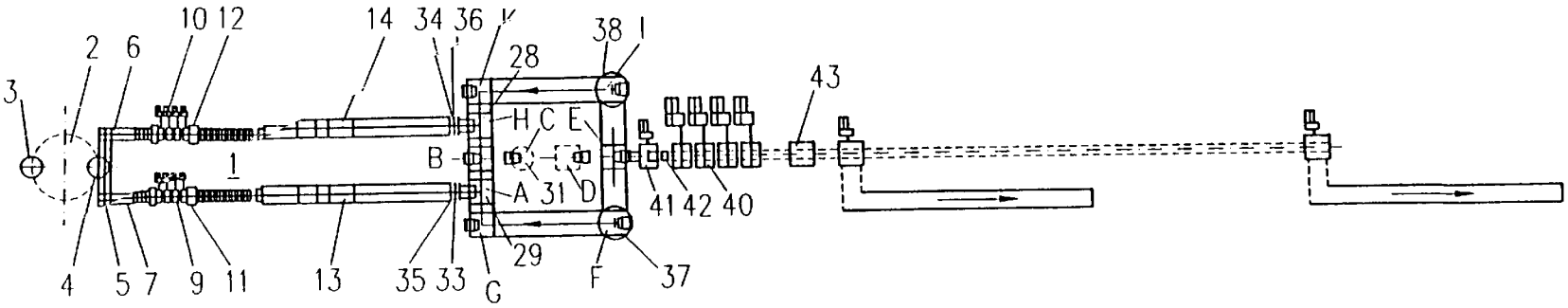
Figure 2:
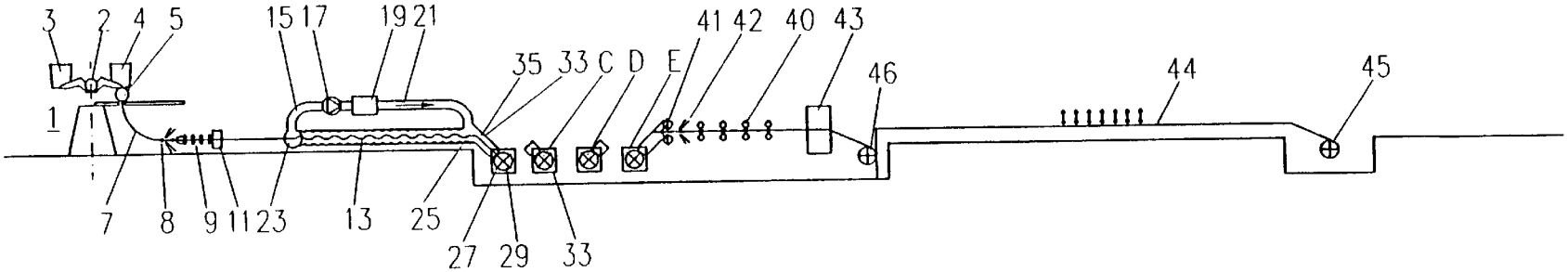

FIG. 1 shows a continuous casting machine 1 for two strands. The continuous casting machine 1 comprises a ladle turret 2 in which two ladles 3 and 4 can be accommodated. Each of the two ladles can contain approximately 300 tons of liquid steel. The continuous casting machine is provided with a tundish 5 which is filled from the ladles 3 and 4 and kept filled. The liquid steel runs out of the tundish into two moulds (not drawn) from where the steel, now in the form of a partially solidified slab with its core still liquid, passes between the rolls of curved roller tables 6 and 7. For some grades of steel t can be an advantage to reduce the steel slab in thickness in roller tables 6 and 7 while its core is still liquid. This is known as squeezing.

Descaling sprays 8 are located on the exit side of the two roller tables 6 and 7, by which oxide scale is sprayed from the slab with a water pressure of approximately 200 bar. Starting with a cast thickness of for example approximately 60 mm, the slab typically still has a thickness following squeezing of approximately 45 mm. By the 3-stand roll trains 9 and 10 the slab is further reduced to a thickness ranging from 10 to 15 mm. If desired the head and the tail may be cut off the slab by the shears 11 and 12, or the slab sheared into parts of a desired length.

Instead of casting a thin slab with a thickness of less than 100 mm, it is also possible to cast a thicker slab and by means of rolling, in particular by means of reversible rolling, to reduce the thickness of the slab to a value ranging from 10 to 15 mm.

This apparatus is used to make a ferritically rolled strip. In this application the slabs are preferably rolled in rolling trains 9 and 10 to a thickness of approximately 10 mm. Furnace apparatuses 13 and 14 are used primarily as cooling apparatus, possibly in combination with extra heating to compensate for heat losses, or to heat the slab locally as required. In addition to, or instead of, the furnace apparatus, cooling using water or air may be employed. To obtain the cooling effect the gas is sucked from the furnace apparatus through suction line 15, arranged into a desired composition and cooled in the conditioning apparatus, and then conveyed back into the furnace apparatus through line 21. Both furnace apparatuses are equipped with such a conditioning apparatus. A suitable value for the temperature of the slab on exiting the furnace apparatus is 780° C.

The slab is coiled in the manner described above into a coil which is moved to position E stored in one of the coiling apparatuses. This allows temperature homogenization in the coiled slab.

The furnace apparatuses 13, 14 are in the form of encloses and are provided with conditioning means for creating and preserving a desired non-oxidizing gaseous atmosphere in the furnace apparatus. In the embodiment shown the conditioning means of a furnace apparatus comprise a suction line 15, a pump 17, gas metering and gas scrubbing means 19 and a supply line 21 along which the gas is pumped into the furnace apparatus. If desired the gas metering and gas scrubbing means 19 may also comprise a gas heating apparatus for compensating for any heat loss. Thus, heat exchangers can be employed to control the gas temperature, using gas combustion to supply heat, and water for cooling.

The furnace apparatus is provided on its entry and exit sides with ports 23, 25 having sealing means to substantially prevent any undesired penetration of gas from the surrounding atmosphere. A suitable value for the temperature of the reduced slab on exiting the furnace apparatus is 780° C. The furnace apparatus is coupled essentially gas-tightly to the coiling apparatus 27, which coiling apparatus 27 itself comprises an essentially gas-tight enclosure in which the slab is coiled into a coil. The coiling apparatus is preferably provided with a mandrel 29 which supports the coil as it is being coiled.

In this embodiment, the gas atmosphere provided in the furnace apparatus also enters the coiling apparatus when the latter is connected to it. Alternatively both the furnace apparatus and the coiling apparatus may be provided with conditioning means, as described above, for providing the desired atmosphere.

As appropriate, virtually synchronously with coiling of a slab onto coiling apparatus 27, a slab cast on the other strand is coiled in coiling apparatus 28 provided with a mandrel 30 (not drawn). Coiling apparatuses 27 and 28 and furnace apparatuses 13 and 14 are each provided with sealing means 33, 35, 34, 36 respectively, by which the coiling apparatuses and the furnace apparatuses may be sealed for uncoupling, so that following uncoupling no gas can penetrate from the outside atmosphere and the gaseous atmosphere in the coiling apparatuses and the furnace apparatuses remains preserved.

The sealing means for the ports of the furnace apparatuses and the coiling apparatuses are suitably steel flaps, biased to the closed position, or they may be doors which are driven. To minimize gas leakage, flexible curtains may additionally be provided.

As soon as the coiling apparatus 27 is filled with a slab coiled into a coil, this coiling apparatus 27 is uncoupled from the furnace apparatus 13 and driven from position A (see FIG. 1) past position B to position C. At position C there is a turnstile 31 (not drawn) by which at position C the coiling apparatus may be rotated through 180° around a vertical axis. Following rotation the coiling apparatus is driven past waiting position D to entry position E. As a coiling apparatus travels from position A to position E, an empty coiling apparatus is driven from position E to a turnstile 37 at position F. Following rotation through 180° around a vertical axis by the turnstile 37, the coiling apparatus is driven past position G to the starting position A and there it is ready for taking up a fresh slab.

A corresponding working method is applicable for the second strand, whereby the coiling apparatus 28 filled with a coil is driven from position B to position C and following 180° rotation to position D. The coiling apparatus stays parked in this position until a coiling apparatus which is currently uncoiling, for example coiling apparatus 27, is empty at position E and driven off to the now vacated position F. As soon as coiling apparatus 28 leaves position B, an empty coiling apparatus from position I, following rotation through 180° around a vertical axis by means of a turnstile 38, is moved via position K to take up the position of the coiling apparatus 28 now driven off. The new slab fed out of the furnace apparatus 14 can be coiled in the empty coiling apparatus. Devices, preferably electrical current conductors (not shown), are fitted along the paths over which the coiling apparatuses travel for providing power for internally heating the coiling apparatuses according to need. For this purpose, the coiling apparatus contains electrical heaters for heating the coils and contacts for pick-up of power from the fixed conductors. Path B, C, D, E is common and used as described by coiling apparatuses of both strands. Position C has a rotation facility and position D is a waiting position in which a coiling apparatus filled with a coil is ready to be moved to position E as soon as it becomes free. Positions C and D may be swapped or may coincide.

In the manner described, a coiling apparatus 27 arrives at position E with its sealing means 33 closed and filled with a coil with a temperature of approximately 780° C. After the sealing means 33 have been opened the extremity of the outer winding corresponding to the tail of the coiled slab is fed into the rolling train. If desired the head by be cut off by crop shears if it does not have a suitable shape or composition for further processing. Should some oxide still have occurred, this can then be removed easily using the high pressure spray 42. In practice oxide formation will be negligible because the slab has been almost constantly in a conditioned gaseous atmosphere. Because the coiling apparatus rotates through 180°, its original infeed which is now the outfeed can be brought up very close to the entry of the rolling train. This also minimizes oxide formation.

In the example shown, the rolling train 40 is provided with four mill stands and is so designed that the slab can be rolled in the ferritic range. For controlling thickness, width and temperature, a measuring and control apparatus 43 may be incorporated in the rolling train, after or between the mill stands.

As described above, the apparatus achieves the effect that less oxide forms as the slab and the strip are being processed. Because of this and because of the lower entry speed in the last rolling train 40 which this achieves as an additional advantage, it is possible to attain a smaller than conventional finished thickness of the hot rolled steel. Exit thicknesses of 1.0 mm and less from the rolling train 40 can be attained with the plant described.

Following any desired cutting off the crop end with shears 41, and if desired, following oxide removal by means of high pressure sprays, the ferritic slab is rolled in the ferritic region in the rolling train 40 to a finished thickness which, as is conventional, ranges between 0.7 mm and 1.5 mm. For most steel grades further cooling is not necessary and the ferritic strip can be coiled into a coil on the coiling apparatus 46 which may be placed at a short distance after the rolling train.

In particular, one of the mill stands of the rolling train 40, being preferably not the first mill stand, applies a thickness reduction of the slab of more than 50%, preferably not more than 55%. One of the mill stands of the train 40 applies lubrication rolling; again this is preferably not the first mill stand.

Coiling of the finished strip in the coiling apparatus 46 is at over 500° C., preferably over 600° C.

Therefore, using the plant in this manner it is possible using the casting heat to manufacture in a successive series of process stages a ferritically rolled steel strip with good properties in particular in terms of the surface quality. External heating after casting may be avoided (except any heat generated by the rolling).

The proposed paths of movement of the coiling apparatus between the furnace apparatus and the rolling train allow for a very compact construction, in particular in a direction transverse to the direction of passage of the steel through the apparatus. This makes it possible to cast simultaneously two strands from just one tundish while using just one ladle turret. This achieves a considerably reduction of the financial capital which needs to be invested in the plant.

We claim:

1. A method for the manufacture of a strip of formable steel, comprising the steps of, in the following order:

(i) by continuous casting, forming liquid steel into a slab having a thickness of not more than 100 mm, (ii) rolling said slab, while still hot from its casting and in the austenitic region, into an intermediate slab having a thickness in the range 5 to 20 mm, (iii) cooling said intermediate slab of step (ii) to a temperature which is below the $Ar_3$ temperature of the steel, (iv) holding said cooled intermediate slab in an enclosure for temperature homogenization thereof, (v) rolling said held intermediate slab into a strip, with at least one rolling pass applying a thickness reduction of more than 50%, said held intermediate slab during rolling being at a temperature in the range from above 200° C. to below a temperature $T_t$ at which 75% of the steel is converted into ferrite, (vi) coiling said strip at a temperature above 500° C.

2. A method according to claim 1 including in step (i) a thickness reduction of the cast steel while its core is still liquid.

3. A method according to claim 1 wherein in said step (iv) said enclosure is provided by at least one of a furnace apparatus containing said intermediate slab and a coiling apparatus in which said intermediate slab is coiled.

4. A method according to claim 1, wherein from the continuous casting of step (i) to the coiling of step (vi) the steel as a whole is not subjected to re-heating, apart from any heat generated by the rolling.

5. A method according to claim 1 wherein the thickness of the strip produced in step (v) is in the range 0.7 to 1.5 mm.

6. A method according to claim 1 wherein step (v) includes at least one pass of lubrication rolling.

7. A method according to claim 1 wherein in step (iv) said intermediate slab is at a temperature below $T_t$ and above 200° C.

* * * * *